US006374073B2

(12) United States Patent
Ozaki et al.

(10) Patent No.: US 6,374,073 B2
(45) Date of Patent: Apr. 16, 2002

(54) IMAGE FORMING MACHINE

(75) Inventors: Akihiro Ozaki; Hideki Ishida, both of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/882,254

(22) Filed: Jun. 18, 2001

(30) Foreign Application Priority Data

Jun. 28, 2000 (JP) ..... 2000-194992
Oct. 30, 2000 (JP) ..... 2000-330411
Oct. 30, 2000 (JP) ..... 2000-330412

(51) Int. Cl.[7] ..... G03G 15/01

(52) U.S. Cl. ..... 399/298; 399/169; 399/176; 399/303; 399/313; 399/314

(58) Field of Search ..... 399/101, 127, 399/168, 169, 174, 176, 298, 302, 303, 313, 314, 350

(56) References Cited

U.S. PATENT DOCUMENTS 5,970,282 A * 10/1999 Yanagida et al. ..... 399/101
5,995,785 A * 11/1999 Kato et al. ..... 399/127

FOREIGN PATENT DOCUMENTS

JP 08-30121 * 2/1996
JP 10-240033 * 9/1998

* cited by examiner

*Primary Examiner*—Arthur T. Grimley
*Assistant Examiner*—Hoang Ngo
(74) *Attorney, Agent, or Firm*—Smith, Gambrell & Russell, LLP

(57) ABSTRACT

An image forming machine comprising image bearing means, charging means, exposure means, reversal development means, transfer means, and cleaning means. The transfer means includes a rotationally driven transfer belt, and transfer voltage applicator means for applying a transfer voltage to the back side of the transfer belt. The transfer voltage applicator means applies the transfer voltage to the transfer belt over a predetermined effective transfer width. The face side of the transfer belt is brought into contact with the image bearing means via an image receiving member and directly over a predetermined effective contact width. The effective contact width is larger than an effective charging width and larger than the effective transfer width.

22 Claims, 8 Drawing Sheets

IMAGE FORMING MACHINE

FIELD OF THE INVENTION

This invention relates to an electrostatic process image forming machine, such as an electrostatic copier, printer or facsimile. More particularly, the invention relates to an image forming machine comprising image bearing means which may be a rotating drum or an endless belt, charging means for charging the image bearing means to a predetermined polarity, exposure means for selectively static-eliminating the charged image bearing means to form an electrostatic latent image, reversal development means for developing the electrostatic latent image on the image bearing means into a toner image, transfer means for transferring the toner image on the image bearing means onto an image receiving member which may be a plain paper, and cleaning means for removing a toner remaining on the image bearing means after transfer.

DESCRIPTION OF THE PRIOR ART

In the foregoing image forming machine, the charging means, which can be composed of a corona discharger, charges the image bearing means to a specific polarity over a predetermined effective charging width. The width of the image bearing means is larger than the effective charging width. On both sides of the effective charging width, the surface of the image bearing means is not stably charged to a predetermined potential, and can be of a potential considerably lower than the predetermined potential, or of substantially zero potential, or even of the opposite polarity. Development by the reversal development means does not apply a toner to a site where the charge potential remains, but applies the toner to a static elimination site where the charge potential has disappeared. In the image forming machine employing the reversal development means, therefore, the toner tends to adhere to both sides of the effective charging width on the surface of the image bearing means, thereby causing staining there. Even if an effective development width by the development means is rendered substantially the same as, or somewhat smaller than, the effective charging width, a floating toner, such as toner repelled by the charge potential on the image bearing means, can adhere onto the image bearing means on both sides of the effective charging width.

As transfer means in the image forming machine in the above-described configuration, a form composed of a transfer roller to receive a transfer voltage, or a form including an endless transfer belt to be rotationally driven, and transfer voltage applicator means for applying a transfer voltage to the back side of the transfer belt has recently been proposed and put to practical use, instead of a transfer corona discharger. The transfer roller or transfer belt is brought into contact with the image bearing means via the image receiving member and directly over the entire width of the transfer roller or transfer belt. The transfer voltage applicator means is usually composed of a voltage applicator roller formed from an electrically conductive material and receiving a transfer voltage. The width of the voltage applicator roller is substantially the same as the width of the transfer belt, so that the transfer belt is contacted with the image bearing means over the entire width of the transfer belt, and given a transfer voltage over its entire width.

If the width of the transfer roller or transfer belt is larger than the aforementioned effective charging width, however, the transfer roller or transfer belt is brought into contact with the image bearing means not via the image receiving member, but directly on both sides of the effective charging width, because a maximum image receiving member is normally somewhat smaller than the effective charging width. As a result, the toner adhering to the image bearing means is transferred onto the transfer roller or transfer belt. Consequently, the surface of the transfer roller or transfer belt is stained with the toner. When both side portions of the face side of the transfer roller or transfer belt are stained with the toner, the state of contact between the image bearing means and the transfer roller or transfer belt is deteriorated, posing problems, such as poor transfer or damage to the surface of the image bearing means. To solve such problems, Japanese Patent No. 2597540 proposes that the width of the transfer roller (or transfer belt) be made smaller than the effective charging width.

If the width of the transfer roller or transfer belt is made smaller than the effective charging width, the toner adhering to the image bearing means on both sides of the effective charging width is prevented from being transferred to the transfer roller or transfer belt, but other problems occur. First, when the width of the transfer roller or transfer belt is made smaller than the effective charging width, the width of the transfer roller or transfer belt becomes nearly equal to or smaller than the width of the maximum image receiving member. As a result, the transportability of the image receiving member by the transfer roller or transfer belt lowers, causing a tendency toward a skew motion or a jam of the image receiving member. Secondly, particularly when the effective cleaning width of the cleaning means is substantially the same as or smaller than the effective charging width, the toner adhering to areas on both sides of the effective charging width on the surface of the image bearing means is not removed, but accumulated, thereby arousing the following phenomena: The accumulated toner accidentally floats, often contaminating the interior or surroundings of the image forming machine. Particularly, the floating toner adheres to the bearing mechanism of the transfer roller, or the bearing mechanism of a support roller for the transfer belt, the transfer voltage applicator means for the transfer roller or transfer belt, and so on, thereby not only staining these members, but also impeding their functions. Furthermore, the charging means, the reversal development means, and the cleaning means are provided with constituent elements extending or located widthwise outwardly of the effective charging width, the effective development width, and the effective cleaning width, respectively, for example, spacing setting rollers for setting spacing from the image bearing means sufficiently precisely, and various sealing members for preventing scatter of toner. The toner adhering to the areas on both sides of the effective charging width on the surface of the image bearing means stagnates and builds up between these constituent elements and the surface of the image bearing means. This is highly likely to destroy the spacing setting function of the spacing setting rollers, spoil the sealing function of the various sealing members, and damage the image bearing means, the spacing setting rollers, or the various sealing members.

SUMMARY OF THE INVENTION

The object of the present invention is to solve the above-described various problems, which are concerned with the toner adhering to both sides of the effective charging width on the surface of the image bearing means, by employing a unique configuration for the transfer means.

In an aspect of the present invention, transfer means is composed of a transfer belt to be rotationally driven, and transfer voltage applicator means for applying a transfer voltage to the back side of the transfer belt, the transfer voltage applicator means applies the transfer voltage to the transfer belt over a predetermined effective transfer width, the face side of the transfer belt is brought into contact with image bearing means via an image receiving member and directly over a predetermined effective contact width, and the effective contact width is set to be larger than the effective charging width of charging means and larger than the effective transfer width.

That is, according to an aspect of the present invention, there is provided, as an image forming machine which attains the above main object, an image forming machine comprising image bearing means moved sequentially through a charging zone, an exposure zone, a development zone, a transfer zone, and a cleaning zone, charging means for charging the image bearing means in the charging zone, exposure means for selectively static-eliminating the image bearing means in the exposure zone to form an electrostatic latent image on the image bearing means, reversal development means for developing the electrostatic latent image into a toner image in the development zone, transfer means for transferring the toner image on the image bearing means onto an image receiving member in the transfer zone, and cleaning means for removing a toner remaining on the image bearing means in the cleaning zone after transfer, the transfer means including a transfer belt to be rotationally driven, and transfer voltage applicator means for applying a transfer voltage to the back side of the transfer belt, and wherein the charging means charges the image bearing means over a predetermined effective charging width, the transfer voltage applicator means applies the transfer voltage to the transfer belt over a predetermined effective transfer width, the face side of the transfer belt is brought into contact with the image bearing means via the image receiving member and directly over a predetermined effective contact width, and the effective contact width is larger than the effective charging width and larger than the effective transfer width.

The effective contact width is preferably larger than the width of the image receiving member of a maximum size. In a preferred embodiment, the transfer means includes belt cleaning means for removing an adhered toner from the face side of the transfer belt, and the effective cleaning width of the belt cleaning means is larger than the effective contact width. The effective transfer width is preferably smaller than the effective charging width. The transfer voltage applicator means can be composed of a voltage applicator roller which is formed from an electrically conductive material and to which the transfer voltage is applied. There can be disposed pressure rollers which are arranged on both sides of the voltage applicator roller and which act on the back side of the transfer belt to press the face side of the transfer belt against the image bearing means. Advantageously, the pressure rollers are concentric with the voltage applicator roller. The voltage applicator roller and the pressure rollers are preferably fixed to an electrically conductive common support shaft which is rotatably mounted. Preferably, the transfer voltage is applied to the voltage applicator roller via the common support shaft, and the pressure rollers are formed from an insulating material.

In other aspect of the present invention, the transfer means is composed of a transfer belt to be rotationally driven, and transfer voltage applicator means for applying a transfer voltage to the back side of the transfer belt, the transfer voltage applicator means applies the transfer voltage to the transfer belt over a predetermined effective transfer width, the face side of the transfer belt is brought into contact with the image bearing means via an image receiving member and directly over a predetermined effective contact width, the effective contact width is set to be larger than the effective development width, the effective cleaning width and/or the effective charging width and larger than the effective transfer width, and spacing setting rollers or various sealing members are arranged in the effective contact width.

That is, according to the other aspect of the present invention, there is provided, as an image forming machine which attains the aforementioned object, an image forming machine comprising image bearing means moved sequentially through a charging zone, an exposure zone, a development zone, a transfer zone, and a cleaning zone, charging means for charging the image bearing means in the charging zone, exposure means for selectively static-eliminating the image bearing means in the exposure zone to form an electrostatic latent image on the image bearing means, reversal development means for developing the electrostatic latent image into a toner image in the development zone, transfer means for transferring the toner image on the image bearing means onto an image receiving member in the transfer zone, and cleaning means for removing a toner remaining on the image bearing means in the cleaning zone after transfer, the transfer means including a transfer belt to be rotationally driven, and transfer voltage applicator means for applying a transfer voltage to the back side of the transfer belt, and wherein the reversal development means develops the image bearing means over a predetermined effective development width, the transfer voltage applicator means applies the transfer voltage to the transfer belt over a predetermined effective transfer width, the face side of the transfer belt is brought into contact with the image bearing means via the image receiving member and directly over a predetermined effective contact width, and the effective contact width is larger than the effective development width and larger than the effective transfer width.

In a preferred embodiment, the development means includes a development housing having an opening at a site facing the image bearing means, developer applicator means disposed in the development housing and adapted to act on the image bearing means through the opening, an upstream sealing member disposed in the development housing and having a free end brought into contact with the image bearing means upstream from the developer applicator means, a pair of side sealing members disposed in the development housing and brought into contact with the image bearing means on both sides of the developer applicator means, and/or a pair of spacing setting rollers rotatably mounted on the development housing and brought into contact with the image bearing means on both sides of the developer applicator means; and the width of the upstream sealing member, the length between the outside ends of the pair of side sealing members, and/or the length between the outside ends of the pair of spacing setting rollers are or is larger than the effective development width and smaller than the effective contact width.

According to the other aspect of the present invention, there is also provided, as an image forming machine which attains the aforementioned object, an image forming machine comprising image bearing means moved sequentially through a charging zone, an exposure zone, a development zone, a transfer zone, and a cleaning zone, charging means for charging the image bearing means in the charging zone, exposure means for selectively static-eliminating the image bearing means in the exposure zone to form an electrostatic latent image on the image bearing means, reversal development means for developing the electrostatic latent image into a toner image in the development zone, transfer means for transferring the toner image on the image bearing means onto an image receiving member in the transfer zone, and cleaning means for removing a toner remaining on the image bearing means in the cleaning zone after transfer, the transfer means including a transfer belt to be rotationally driven, and transfer voltage applicator means for applying a transfer voltage to the back side of the transfer belt, and wherein the cleaning means removes the toner remaining on the image bearing means over a predetermined effective cleaning width, and the transfer voltage applicator means applies the transfer voltage to the transfer belt over a predetermined effective transfer width, the face side of the transfer belt is brought into contact with the image bearing means via the image receiving member and directly over a predetermined effective contact width, and the effective contact width is larger than the effective cleaning width and larger than the effective transfer width.

In a preferred embodiment, the cleaning means includes a cleaning housing having an opening at a site facing the image bearing means, a cleaning blade disposed in the cleaning housing and having a front edge portion pressed against the image bearing means, an upstream sealing member disposed in the cleaning housing and having a free end brought into contact with the image bearing means upstream from the cleaning blade, and/or a pair of side sealing members disposed in the cleaning housing and brought into contact with the image bearing means on both sides of the cleaning blade; and the width of the upstream sealing member, and/or the length between the outside ends of the pair of side sealing members are or is larger than the effective cleaning width and smaller than the effective contact width.

According to the other aspect of the present invention, moreover, there is provided, as an image forming machine which attains the aforementioned object, an image forming machine comprising image bearing means moved sequentially through a charging zone, an exposure zone, a development zone, a transfer zone, and a cleaning zone, charging means for charging the image bearing means in the charging zone, exposure means for selectively static-eliminating the image bearing means in the exposure zone to form an electrostatic latent image on the image bearing means, reversal development means for developing the electrostatic latent image into a toner image in the development zone, transfer means for transferring the toner image on the image bearing means onto an image receiving member in the transfer zone, and cleaning means for removing a toner remaining on the image bearing means in the cleaning zone after transfer, the transfer means including a transfer belt to be rotationally driven, and transfer voltage applicator means for applying a transfer voltage to the back side of the transfer belt, and wherein the charging means includes a corona discharger for charging the image bearing means over a predetermined effective charging width, and a pair of spacing setting rollers rotatably mounted on the corona discharger and brought into contact with the image bearing means on both sides of the effective charging width, and the length of the outside ends of the pair of spacing setting rollers is larger than the effective charging width and smaller than the effective contact width.

DETAILED DESCRIPTION OF THE PREFERRED EMBODIMENTS

Preferred embodiments of an image forming machine constituted in accordance with the present invention will now be described in more detail with reference to the accompanying drawings.

Figure 1:
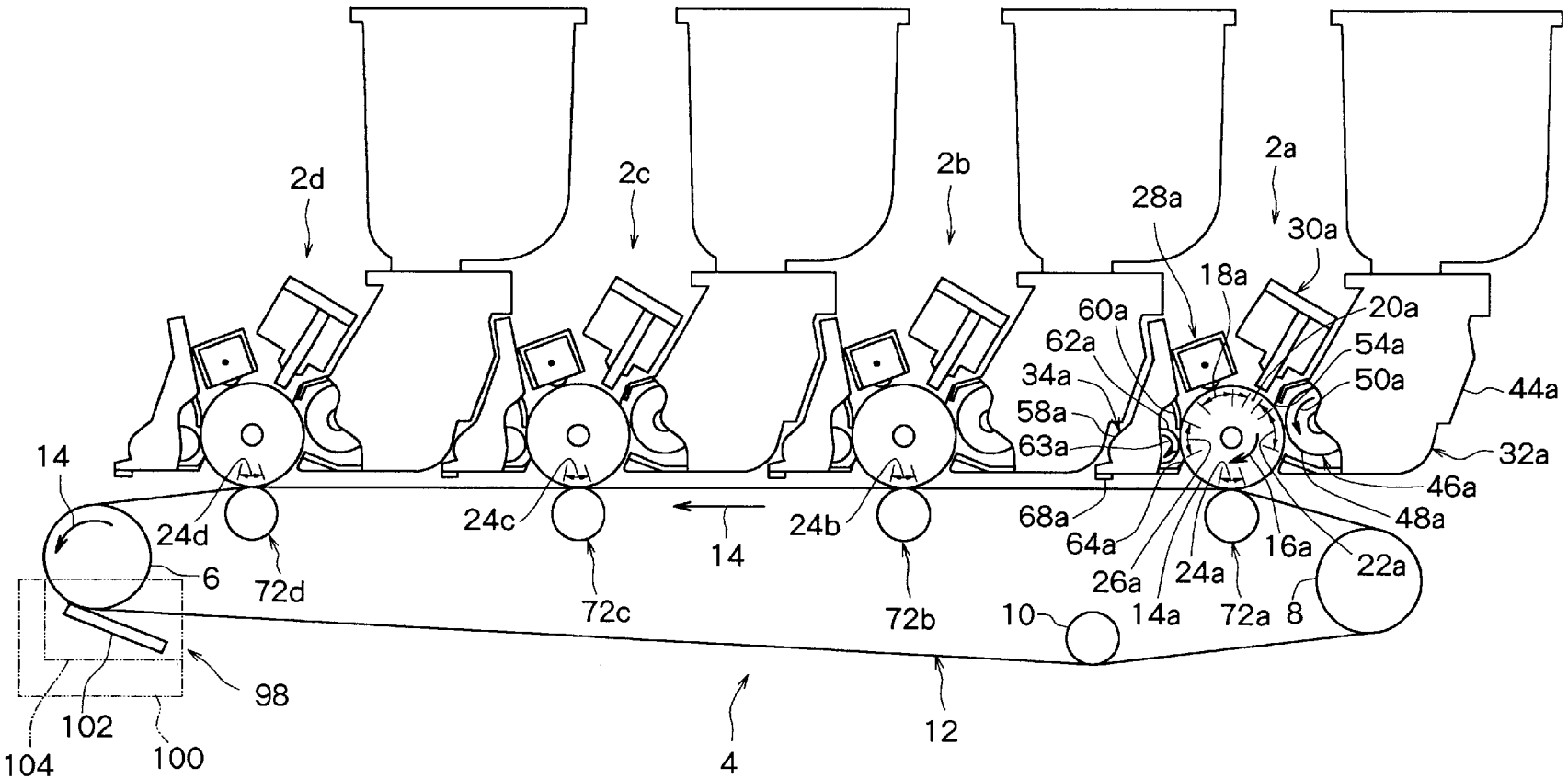
FIG. 1 is a schematic view showing main constituent elements of a preferred embodiment of an image forming machine constituted in accordance with the present invention.

FIG. 1 schematically shows main constituent elements in a preferred embodiment of an image forming machine constituted in accordance with the present invention. The illustrated image forming machine has four image forming units arranged in tandem, i.e., a black toner image forming unit 2*a*, a magenta toner image forming unit 2*b*, a cyan toner image forming unit 2*c*, and a yellow toner image forming unit 2*d*, and one transfer belt unit 4. This image forming machine can form a color image. The transfer belt unit 4 includes a driven roller 6, a follower roller 8, and a tension roller 10, and an endless transfer belt 12 looped over these rollers. (The transfer belt unit 4 further includes voltage applicator rollers constituting four voltage applicator means, and pressure rollers annexed to the voltage applicator rollers, but these rollers will be described later on in detail.) The driven roller 6 and the follower roller 8 are disposed with a predetermined spacing in the right-and-left direction in FIG. 1. The transfer belt 12 can be formed from a flexible material having electrical conductivity, such as an electrically conductive synthetic rubber. The driven roller 6 is rotationally driven in a direction indicated by an arrow 14, whereby the transfer belt 12 is rotationally driven in the direction indicated by the arrow 14. The black toner image forming unit 2*a*, the magenta toner image forming unit 2*b*, the cyan toner image forming unit 2*c*, and the yellow toner image forming unit 2*d* are arranged tandem in such a manner as to be opposed to an upper travel portion of the transfer belt 12 in the transfer belt unit 4.

The black toner image forming unit 2*a*, the magenta toner image forming unit 2*b*, the cyan toner image forming unit 2*c*, and the yellow toner image forming unit 2*d* are substantially the same, except that these image forming units form toner images of different colors (thus, the colors of the toners used in the respective development means are different). Hence, the configuration of the black toner image forming unit 2*a* will be described in detail, and details of the configurations of the magenta toner image forming unit 2*b*, the cyan toner image forming unit 2*c*, and the yellow toner image forming unit 2*d* will not be described in order to avoid a duplicate explanation. The black toner image forming unit 2*a* has a rotating drum 14*a* constituting image bearing means. An electrophotographic photoconductor is disposed on the outer peripheral surface of the rotating drum 14*a*. The rotating drum 14*a* is rotationally driven in a direction indicated by an arrow 16*a*, and its outer peripheral surface is moved through a charging zone 18*a*, an exposure zone 20*a*, a development zone 22*a*, a transfer zone 24*a*, and a cleaning zone 26*a* in this sequence. In the charging zone 18*a*, the outer peripheral surface of the rotating drum 14*a* is charged to a specific polarity by charging means 28*a*. In the exposure zone 20*a*, the outer peripheral surface of the rotating drum 14*a* is selectively exposed by exposure means 30*a* to have its static electricity eliminated. As a result, an electrostatic latent image is formed on the outer peripheral surface of the rotating drum 14*a*. In the development zone 22*a*, a black toner is applied to the electrostatic latent image on the outer peripheral surface of the rotating drum 14*a* by reversal development means 32*a* to develop the electrostatic latent image into a black toner image. The reversal development means 32*a* develops the electrostatic latent image into the toner image by a so-called reversal development process; namely, it selectively adheres the toner, which has been charged to the same polarity as the charge given onto the outer peripheral surface of the rotating drum 14*a* by the charging means 28*a*, to the static-eliminated area in the outer peripheral surface of the rotating drum 14*a*, thereby developing the electrostatic latent image into the toner image. In the area in the outer peripheral surface of the rotating drum 14*a*, where the electric charge remains without being static-eliminated, adhesion of the toner is inhibited by an electrostatic repulsive action. In the transfer zone 24*a*, the black toner image on the outer peripheral surface of the rotating drum 14*a* is transferred onto an image receiving member, which is transported through the transfer zone 24*a*, by the action of transfer means to be described later on in detail. The image receiving member may be a plain paper sheet. In the cleaning zone 26*a*, the toner remaining on the outer peripheral surface of the rotating drum 14*a* is removed from there by the cleaning means 34*a*.

Figure 2:
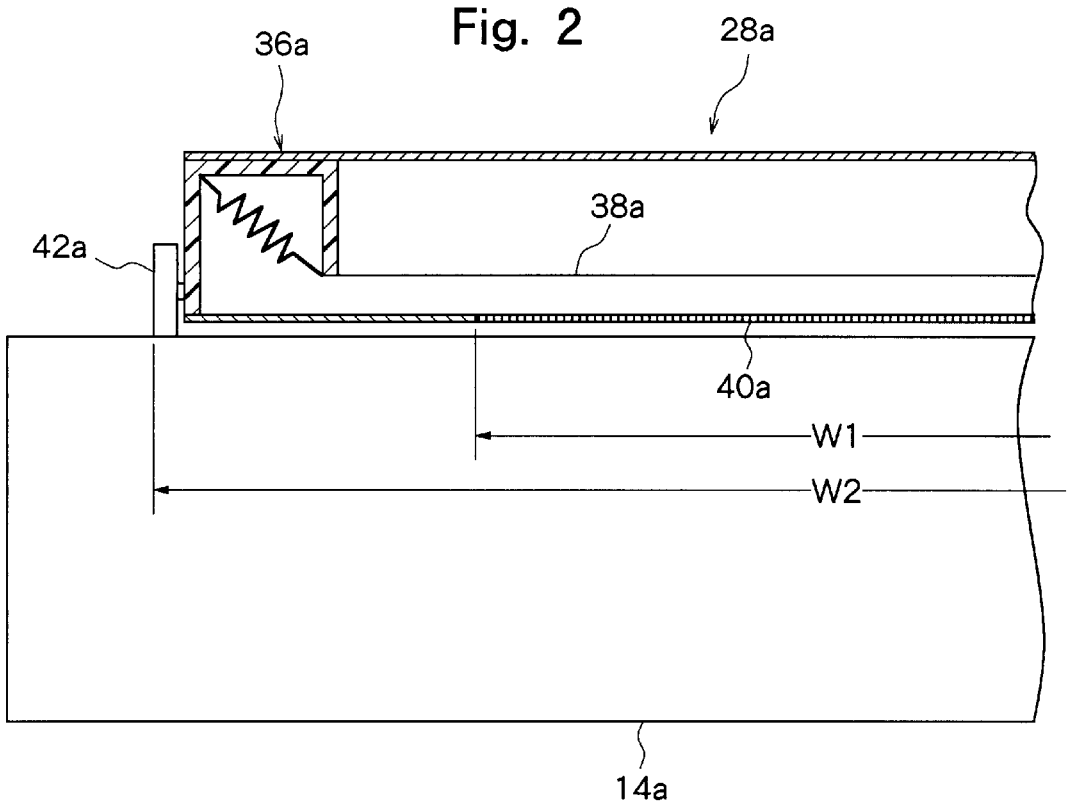
FIG. 2 is a schematic partial sectional view showing charging means in the image forming machine illustrated in FIG. 1.

FIG. 2 shows the charging means 28*a* in the black toner image forming unit 2*a*. The charging means 28*a* in the illustrated embodiment is composed of a corona discharger, and has a shield case 36*a* extending in the axial direction of the rotating drum 14*a*. The shield case 36*a* is in the shape of an elongated box having a surface facing the rotating drum 14*a*, i.e., a lower surface, opened. An electrically conductive wire 38*a* extending in the axial direction of the rotating drum 14*a* is provided tautly in the shield case 36*a*. A grid 40*a* is disposed on the lower surface of the shield case 36*a*. Many slits are formed in a main portion of the grid 40*a*, except its opposite end portions. In an area of a width W1, where the many slits are formed, a corona discharge is applied to the outer peripheral surface of the rotating drum 14*a* to charge the outer peripheral surface of the rotating drum 14*a* to a specific polarity. In the opposite end portions of the grid 40*a*, the corona discharge is blocked by the grid 40*a*. Thus, the charging means 28*a* charges the outer peripheral surface of the rotating drum 14*a* in the area of the width W1, but does not substantially charge the outer peripheral surface of the rotating drum 14*a* on both sides of the width W1. Hence, the width W1 is nothing other than the effective charging width of the charging means 28*a*. The illustrated charging means 28*a* further has spacing setting rollers 42*a* rotatably mounted on the shield case 36*a* on both sides of the grid 40*a*. The outer peripheral surface of the spacing setting roller 42*a* protrudes beyond the lower surface of the shield case 36*a*. By contacting the spacing setting roller 42*a* with the outer peripheral surface of the rotating drum 14*a*, the spacing between the outer peripheral surface of the rotating drum 14*a* and the grid 40*a* of the charging means 28*a* is set at a predetermined value. The length between the widthwise outside ends of the pair of spacing setting rollers 42*a* is larger than W1 of the effective charging width W1, and is W2.

The exposure means 30*a* may be of a form well known per se, in which many light emitting devices are arranged in the axial direction of the rotating drum 14*a*. This exposure means 30*a* selectively exposes the circumferential surface of the rotating drum 14*a* over a maximum exposure width W3 (FIG. 10) to form a required electrostatic latent image.

Figure 3:
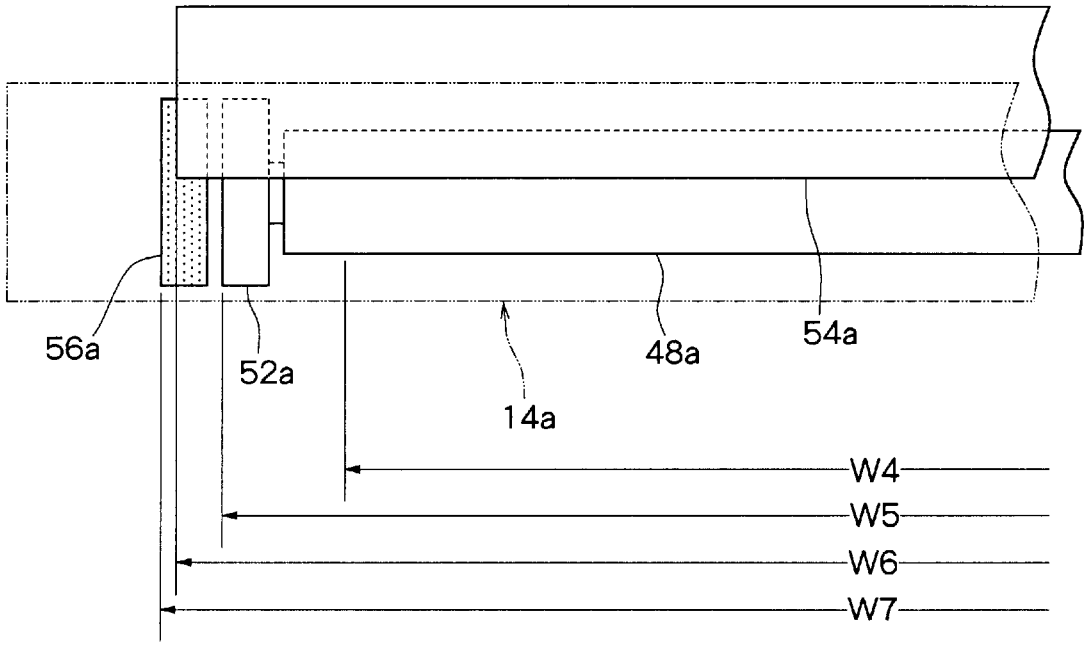
FIG. 3 is a schematic partial sectional view showing development means in the image forming machine illustrated in FIG. 1.

With reference to FIG. 3 along with FIG. 1, the reversal development means 32*a*, which may be of a form well known per se, includes a development housing 44*a* accommodating a developer (not shown). The developer may be a two-component developer consisting of a toner and carrier particles, or a one-component developer consisting of only a toner. In the development housing 44*a*, an opening is formed at a site facing the outer peripheral surface of the rotating drum 14*a*. Developer applicator means 46*a* is disposed in the development housing 44*a*, and the developer applicator means 46*a* has a sleeve member 48*a* extending in the axial direction of the rotating drum 14*a*. The outer peripheral surface of the sleeve member 48*a* partially protrudes through the opening of the development housing 44*a*. A stationary magnet (not shown) is disposed in the sleeve member 48*a*, and the sleeve member 48*a* is rotationally driven in a direction indicated by an arrow 50*a*. The developer is held on the outer peripheral surface of the sleeve member 48*a* by the magnetic attraction force of the stationary magnet, and this developer is applied to the electrostatic latent image formed on the outer peripheral surface of the rotating drum 14*a*. In the illustrated embodiment, the stationary magnet is placed in the area of the width W4, and the sleeve member 48*a* holds the developer on its outer peripheral surface in the area of the width W4 to apply the developer to the outer peripheral surface of the rotating drum 14*a*. Thus, the width W4 is the effective development width of the reversal development means 32*a*. On both sides of the sleeve member 48*a*, spacing setting rollers 52*a* are rotatably disposed. The outer diameter of the spacing setting roller 52*a* is larger than the outer diameter of the sleeve member 48*a* by a predetermined amount, and the spacing setting rollers 52*a* are brought into contact with the outer peripheral surface of the rotating drum 14*a*, whereby spacing between the outer peripheral surface of the sleeve member 48*a* and the outer peripheral surface of the rotating drum 14*a* is set at a predetermined value. The length between the outside ends of the pair of spacing setting rollers 52*a* is larger than the effective development width W4, and is W5. In the development housing 44*a*, an upstream sealing member 54*a* and a pair of side sealing members 56*a* are disposed in relation to the aforementioned opening. The upstream sealing member 54*a*, which can be formed from a suitable plastic film, is in the shape of a strip slenderly extending in the axial direction of the rotating drum 14*a*. A free end of the upstream sealing member 54*a* is contacted with the outer peripheral surface of the rotating drum 14*a* upstream from the development zone 22*a*. The pair of side sealing members 56*a*, which can be formed from a flexible material such as a pile sheet, are contacted with the outer peripheral surface of the rotating drum 14*a* on both sides of the developer applicator means 46*a*. The upstream sealing member 54*a* and the pair of side sealing members 56*a* are disposed to prevent the toner in the developer accommodated in the development housing 44*a* from being scattered to the surroundings. The upstream sealing member 54*a* has a width W6 which is larger than the effective development width W4. The length between the outside ends of the pair of side sealing members 56*a* is also larger than the effective development width W4, and is W7.

Figure 4:
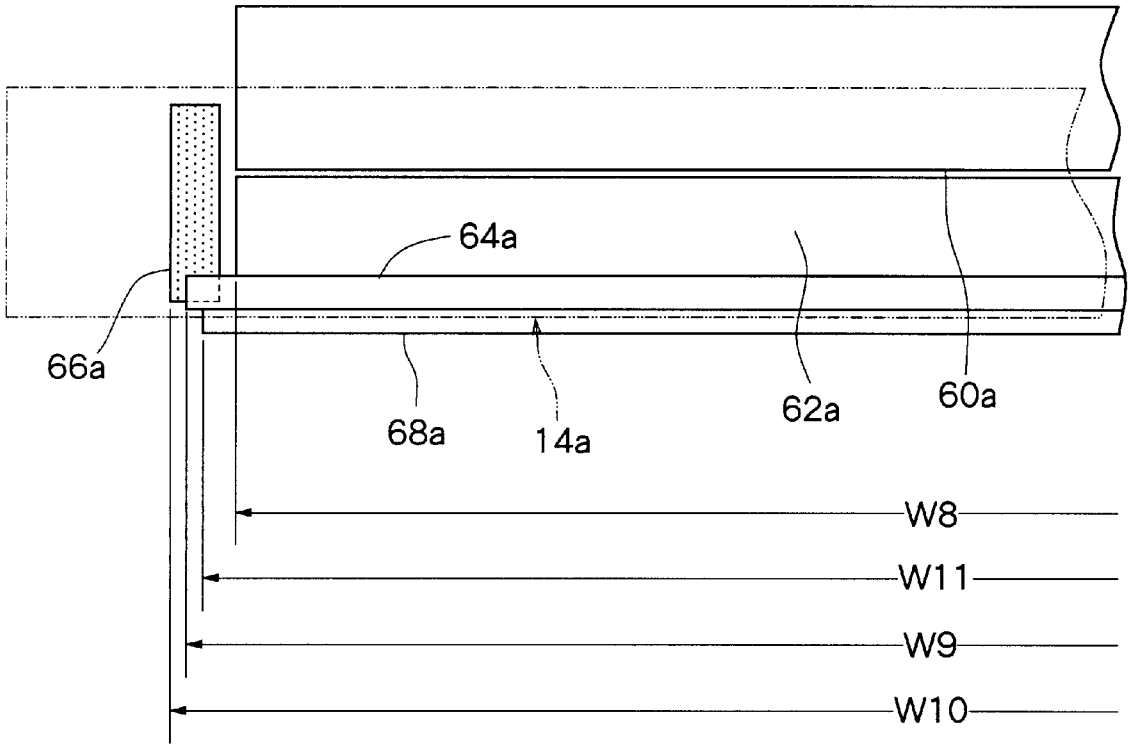
FIG. 4 is a schematic partial sectional view showing cleaning means in the image forming machine illustrated in FIG. 1.

Referring to FIG. 4 along with FIG. 1, the cleaning means 34*a*, which may be of a form well known per se, includes a cleaning housing 58*a*. An opening is formed at a site of the cleaning housing 58*a* which faces the outer peripheral surface of the rotating drum 14*a*. A cleaning blade 60*a* and a cleaning brush 62*a* are mounted on the cleaning housing 58*a*. The cleaning blade 60*a* is formed from a flexible material such as synthetic rubber, and its front end portion is pressed against the outer peripheral surface of the rotating drum 14*a*. The cleaning brush 62*a* is rotated in a direction indicated by an arrow 63*a*, and a flexible brush disposed on its outer peripheral surface acts on the outer peripheral surface of the rotating drum 14*a*. The cleaning brush 62*a* partially removes the toner remaining on the circumferential surface of the rotating drum 14*a* after transfer, and exerts a so-called unraveling action on the remaining toner. The cleaning blade 60*a* removes the toner, which has undergone the unraveling action, from the outer peripheral surface of the rotating drum 14*a*. The cleaning blade 60*a* slenderly extends in the axial direction of the rotating drum 14*a* over a width W8, and the width W8 is the effective cleaning width of the cleaning means 34*a*. The width of the cleaning brush 62*a* is substantially the same as the width W8, and both ends of the cleaning brush 62*a* substantially align with both ends of the cleaning blade 60*a*. In the cleaning housing 58*a*, an upstream sealing member 64*a* and a pair of side sealing members 66*a* are disposed in relation to the aforementioned opening. The upstream sealing member 64*a*, which can be formed from a suitable plastic film, is in the shape of a strip slenderly extending in the axial direction of the rotating drum 14*a*. A free end of the upstream sealing member 64*a* is contacted with the outer peripheral surface of the rotating drum 14*a* upstream from the cleaning zone 26*a*. The pair of side sealing members 66*a*, which can be formed from a flexible material such as a pile sheet, are contacted with the outer peripheral surface of the rotating drum 14*a* on both sides of the cleaning blade 60*a* and cleaning brush 62*a*. The upstream sealing member 64*a* and the pair of side sealing members 66*a* are disposed to prevent the toner, which has been removed from the outer peripheral surface of the rotating drum 14*a* and accommodated into the cleaning housing 58*a*, from being scattered to the surroundings. The upstream sealing member 64*a* has a width W9 which is larger than the effective cleaning width W8. The length between the outside ends of the pair of side sealing members 66*a* is also larger than the effective cleaning width W8, and is W10. On the lower surface of the cleaning housing 58*a*, static eliminator means 68*a* is disposed. The static eliminator means 68*a* can be formed, for example, from many light emitting devices arranged in the axial direction of the rotating drum 14*a*. The static eliminator means 68*a* irradiates the outer peripheral surface of the rotating drum 14*a* between the transfer zone 24*a* and the cleaning zone 26*a* to eliminate a residual electric charge on the outer peripheral surface of the rotating drum 14*a*. The static eliminator means 68*a* irradiates the outer peripheral surface of the rotating drum 14*a* over an effective static elimination width W11 which is larger than the effective cleaning width W8.

Figure 5:
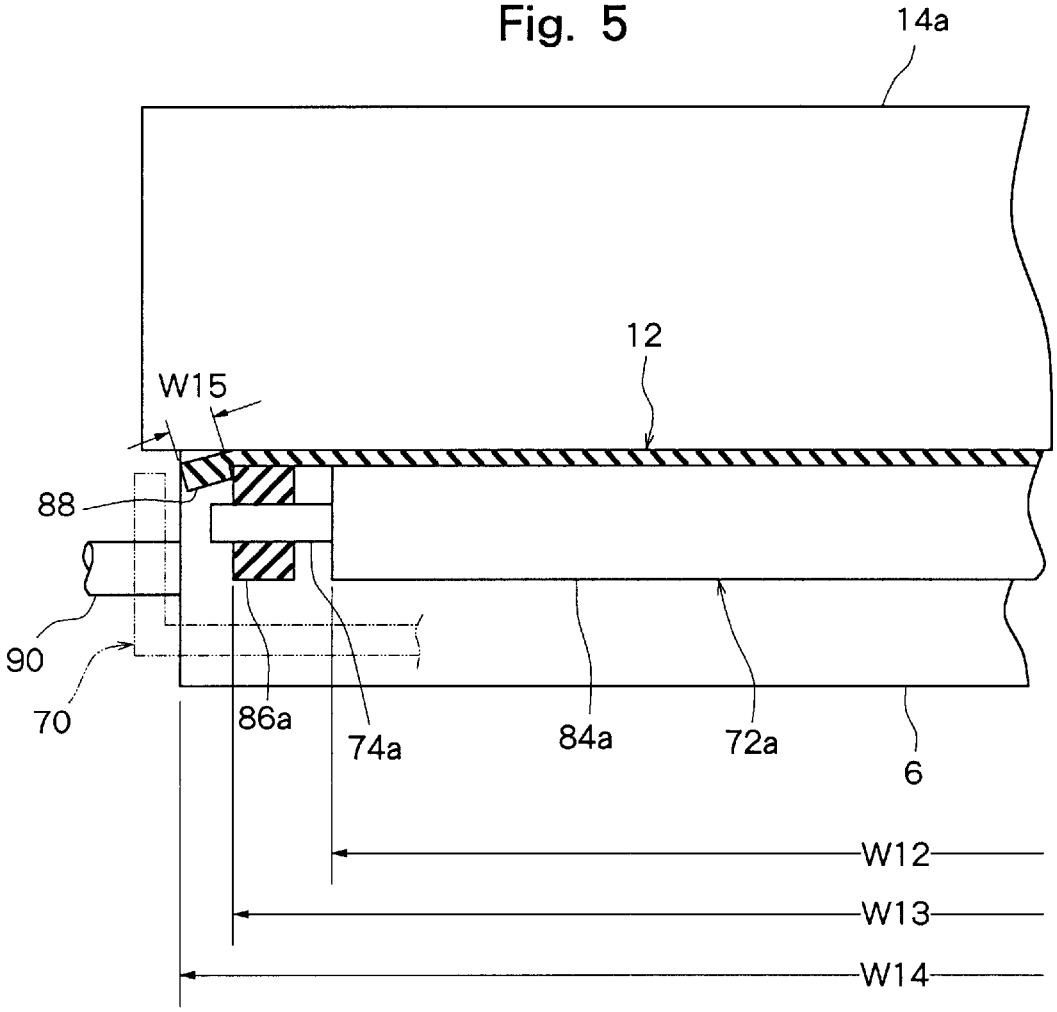
FIG. 5 is a schematic partial sectional view showing transfer means in the image forming machine illustrated in FIG. 1.
Figure 6:
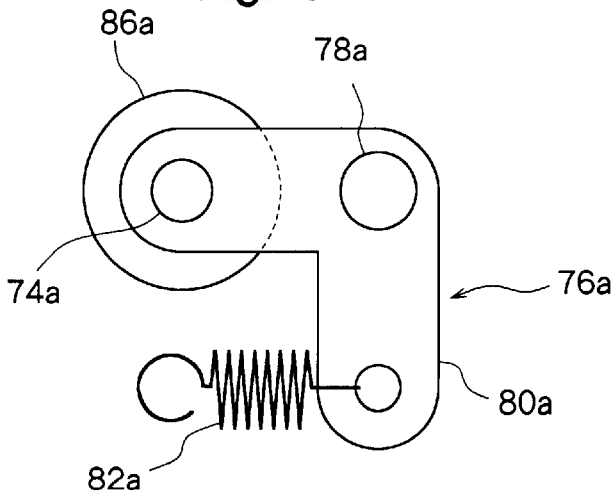
FIG. 6 is a schematic view showing the manner of mounting of a voltage applicator roller and a pressure roller in the transfer means in the image forming machine illustrated in FIG. 1.

The transfer belt unit 4 constituting transfer means includes a support frame 70 (partly indicated by a two-dot chain line in FIG. 5) disposed at a predetermined position in a housing (not shown) of the image forming machine. The aforementioned driven roller 6, follower roller 8 and tension roller 10 are rotatably mounted on the support frame 70. The illustrated transfer belt unit 4 has transfer voltage applicator means 72*a*, 72*b*, 72*c* and 72*d* disposed in relation to the transfer zones 24*a*, 24*b*, 24*c* and 24*d* of the aforementioned four image forming units, i.e., black toner image forming unit 2*a*, magenta toner image forming unit 2*b*, cyan toner image forming unit 2*c*, and yellow toner image forming unit 2*d*. FIGS. 5 and 6 showing the transfer voltage applicator means 72*a* will be referred to for further detailed description. Each of opposite end portions of a common support shaft 74*a* extending in the right-and-left direction in FIG. 5 and in a direction perpendicular to the sheet face in FIGS. 1 and 6 is supported on the support frame 70 via a shaft support mechanism 76*a* (FIG. 6). The common support shaft 74*a* can be formed from a suitable electrically conductive metal material such as steel. The support frame 70 has opposite side plate portions arranged with spacing in the right-and-left direction in FIG. 5. A short support shaft 78*a* protruding substantially horizontally is fixed to each of the opposite side plates. Each of the shaft support mechanisms 76*a* includes an inverted L-shaped swivel plate 80*a* pivotably mounted on each of the short support shafts 78*a*. One end of the common support shaft 74*a* is rotatably mounted on one end portion of each of the swivel plates 80*a*. A tension spring 82*a* is disposed between the other end of the swivel plate 80*a* and the support frame 70, so that the swivel plate 80*a* is elastically urged clockwise in FIG. 6.

As clearly shown in FIG. 5, a voltage applicator roller 84*a* constituting the voltage applicator means 72*a* is fixed to the common support shaft 74*a*. A pair of pressure rollers 86*a*, which are arranged on both sides of the voltage applicator roller 84*a*, are also fixed to the common support shaft 74*a*. The voltage applicator roller 84*a* is advantageously formed from a relatively flexible material having electrical conductivity, e.g., electrically conductive synthetic rubber. On the other hand, the pressure roller 86*a* is advantageously formed from a relatively flexible material having insulating properties, e.g., insulating synthetic rubber. Preferably, the resistance value of the pressure roller 86*a* is about $10^4$ Ω to $10^{12}$ Ω higher than the resistance value of the voltage applicator roller 84*a*. A required transfer voltage is applied to the voltage applicator roller 84*a* via the common support shaft 74*a* and the swivel plate 80*a*. As will be clearly understood by reference to FIG. 6 along with FIG. 5, the swivel plate 80*a* is elastically urged by the tension spring 82*a* clockwise in FIG. 6, so that the voltage applicator roller 84*a* and the pressure rollers 86*a* are elastically urged upward in FIG. 5. As a result, the voltage applicator roller 84*a* and the pressure rollers 86*a* are elastically pressed against the outer peripheral surface of the rotating drum 14*a* in the black toner image forming unit 2*a* via the transfer belt 12. The transfer voltage applied to the voltage applicator roller 84*a* is transmitted to the transfer belt 12. In the transfer zone 24*a*, therefore, the transfer voltage is applied to an image receiving member (not shown) being transported between the outer peripheral surface of the rotating drum 14*a* and the transfer belt 12 in the area where the voltage applicator roller 84*a*extends, i.e., the area of a width W12, whereby a black toner image is transferred from the outer peripheral surface of the rotating drum 14*a* to the image receiving member in the area of the width W12. Hence, the width W12 is an effective transfer width. The pressure rollers 86*a*have insulating properties, so that an effective transfer voltage is not applied to the transfer belt 12 at a site outward of the width W12. However, because of the presence of the pair of pressure rollers 86*a*, the transfer belt 12 is pressed against the outer peripheral surface of the rotating drum 14*a* in the area of a width W13 which is larger than the effective transfer width. Therefore, the width W13 is an effective contact width over which the transfer belt 12 is brought into contact with the outer peripheral surface of the rotating drum 14*a* via the image receiving member at a site where the image receiving member is present, and directly at a site where the image receiving member is not present. In the illustrated embodiment, as will be clearly shown in FIG. 5, the transfer belt 12 has a width W14 which is larger than the effective contact width W13. Hence, non-contact portions, which are not sufficiently intimately contacted by the outer peripheral surface of the rotating drum 14*a*, are existent in both side portions of the transfer belt 12. In such non-contact portions, protrusions 88 having a width W15 are formed in the inner surface of the transfer belt 12 (the protrusion 88 will be further described later on). The width of the rotating drum 14*a* may be substantially the same as or somewhat larger than the width W14 of the transfer belt 12.

Figure 7:
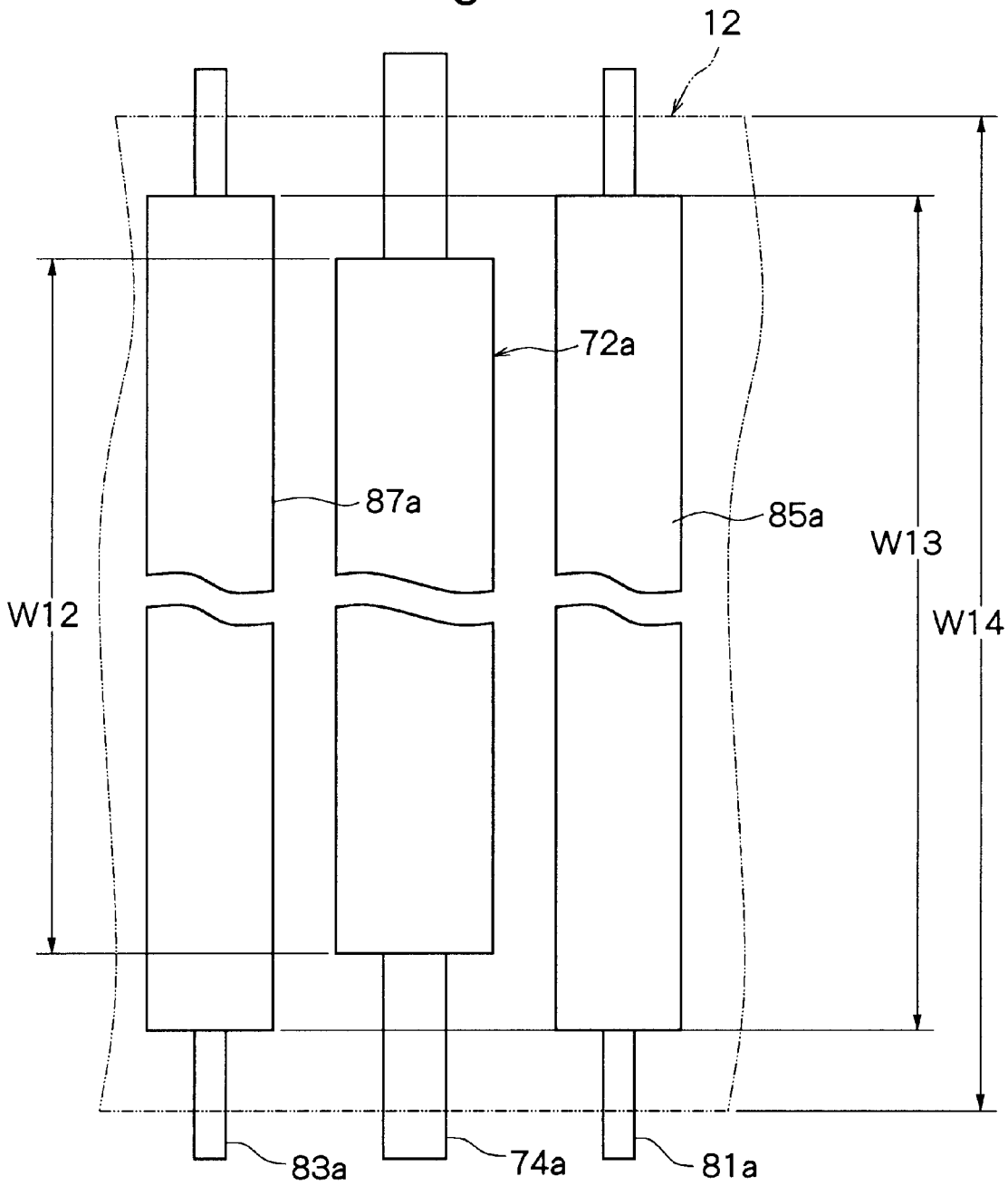
FIG. 7 is a schematic partial plan view showing a modification of the pressure rollers.
Figure 8:
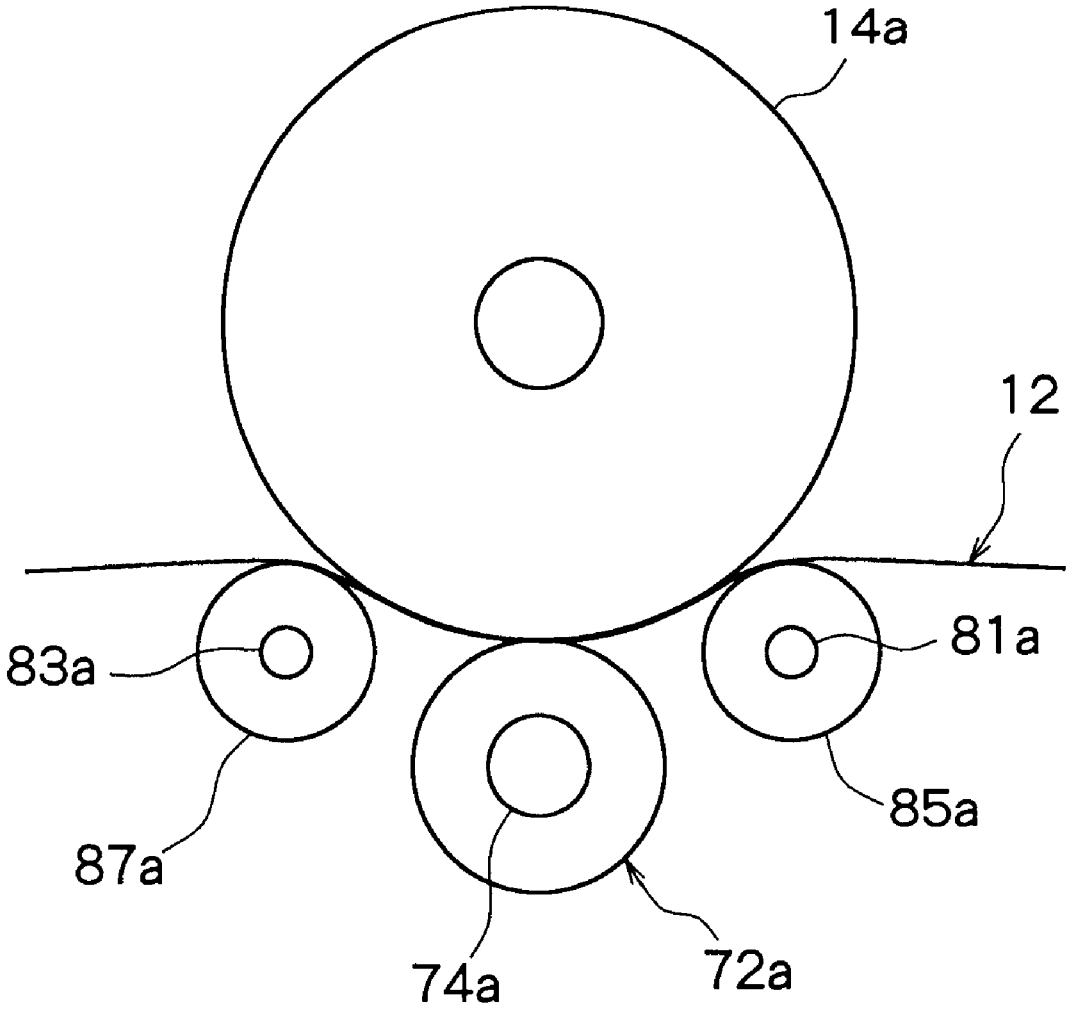
FIG. 8 is a schematic side view of the modification shown in FIG. 7.

In FIGS. 7 and 8, a modification of the pressure rollers is shown. In this modification, support shafts 81*a* and 83*a* are disposed upstream and downstream, when viewed in the direction of movement of the transfer belt 12, separately from the support shaft 74 on which the voltage applicator roller 72*a* is mounted. Pressure rollers 85*a* and 87*a* are fixed to the support shafts 81*a* and 83*a*, respectively. The support shafts 81*a* and 83*a* are rotatably mounted by suitable support mechanisms (not shown), and are elastically urged toward the outer peripheral surface of the rotating drum 14*a*. Thus, the pressure rollers 85*a* and 87*a* are pressed against the outer peripheral surface of the rotating drum 14*a* via the transfer belt 12. The pressure rollers 85*a* and 87*a*, which can be formed from a relatively flexible, insulating material such as insulating synthetic rubber, have an axial length larger than the effective transfer width W12, the axial length of the voltage applicator roller 72*a*, but smaller than the width 14 of the transfer belt 12. The transfer belt 12 is brought into intimate contact with the outer peripheral surface of the rotating drum 14*a* over the effective contact width W13 corresponding to this axial length. If desired, the pressure roller 85*a* or 87*a* may be disposed only upstream or downstream from the voltage applicator roller 72*a*, when viewed in the direction of movement of the transfer belt 12.

The transfer voltage applicator means 72*a*, disposed in relation to the transfer zone 24*a* of the black toner image forming unit 2*a*, and the constituent elements related to the transfer voltage applicator means 72*a* have been described. The transfer voltage applicator means 72*b*, 72*c* and 72*d*, disposed in relation to the transfer zones 24*b*, 24*c* and 24*d* of the magenta toner image forming unit 2*b*, cyan toner image forming unit 2*c*, and yellow toner image forming unit 2*d*, and the constituent elements related thereto are also substantially the same in constitution. Thus, their detailed descriptions will be omitted.

Figure 9:
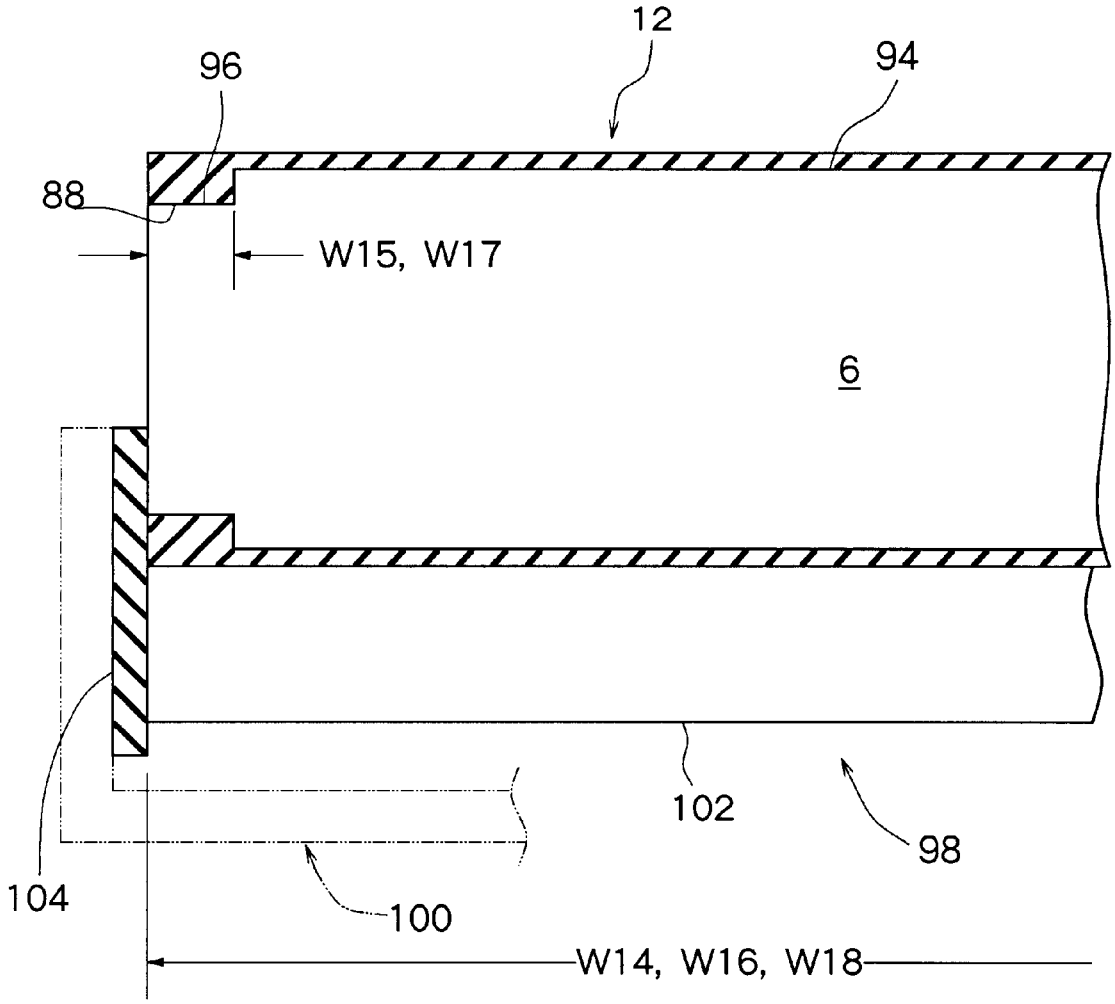
FIG. 9 is a schematic partial sectional view showing belt cleaning means in the transfer means of the image forming machine illustrated in FIG. 1.

With reference to FIG. 9 along with FIGS. 1 and 5, a support shaft 90 extending in the right-and-left direction in FIG. 5 and in a direction perpendicular to the sheet face in FIG. 1 is rotatably mounted on the support frame 70, and the driven roller 6 is fixed to the support shaft 90. One end portion of the support shaft 90 protrudes beyond the one side plate portion of the support frame 70, and an input gear (not shown) is fixed to this protruding end portion. The input gear is connected to a rotational drive source (not shown), which may be an electric motor, via suitable transmission means. When the rotational drive source is energized, the driven roller 6 is rotationally driven in the direction indicated by the arrow 14 in FIG. 1. As clearly shown in FIG. 9, the driven roller 6 has a central main portion 94, and small-diameter portions 96 arranged on both sides. The entire width W16 of the driven roller 6 is substantially the same as the entire width W14 of the transfer belt 12, while the width W17 of the small-diameter portion 96 is substantially the same as the width W15 of the protruding portion 88 formed on each of the opposite side portions of the transfer belt 12. The difference in radius between the central main portion 94 of the driven roller 6 and its small-diameter portion 96 may be substantially the same as the thickness of the protrusion of the protruding portion 88 in the transfer belt 12. As shown in FIG. 9, therefore, the transfer belt 12 is engaged with the outer peripheral surface of the central main portion 94 of the driven roller 6 in the area between the protruding portions 88 at the opposite side portions of the transfer belt 12, and the protruding portions 88 at the opposite side portions of the transfer belt 12 are located at the small-diameter portions 96 on both sides of the driven roller 6. The follower roller 8 and the tension roller 10 have nearly the same configuration as that of the driven roller 6. Since the protruding portions 88 formed on both sides of the transfer belt 12 are located at the small-diameter portions formed on both sides of the driven roller 6, follower roller 8 and tension roller 10, a zigzag movement of the transfer belt 12 is prevented.

As shown in FIGS. 1 and 9, belt cleaning means 98 is disposed below a site where the driven roller 6 is disposed. The belt cleaning means 98 includes a cleaning case 100, and a cleaning blade 102. The cleaning blade 102, which can be formed from a flexible material such as synthetic rubber, is fixed at a predetermined position, and its free end is pressed against the face side of the transfer belt 12. The cleaning case 100 fixed at a required position may be in the shape of a box surrounding the cleaning blade 102. As will be further mentioned later on, the toner can adhere to the face side of the transfer belt 12. However, the free end of the cleaning blade 102 is pressed against the driven roller 6 via the transfer belt 12, whereby the cleaning blade 102 removes the toner adhering to the face side of the transfer belt 12 from there. The removed toner is accommodated into the cleaning case 100. The cleaning blade 102 has substantially the same width W18 as the width W14 of the transfer belt 12, and removes the adhering toner from the face side of the transfer belt 12 over the entire region of the width W18. Accordingly, the width W18 is the effective cleaning width of the belt cleaning means 98. Side sealing pieces 104, which are intimately contacted with the end surfaces of the driven roller 6, the side surfaces of the transfer belt 12 and the side surfaces of the cleaning blade 102, can be disposed on the inner surfaces of both side walls of the cleaning case 100 extending upward beyond the lower surface of the driven roller 6. The sealing piece 104 can be formed from a flexible material such as a pile sheet. If desired, it is permissible to dispose an upstream sealing piece and a downstream sealing piece (not shown), which are closely contacted with the face side of the transfer belt 12 and which are advantageously formed from a plastic film, upstream and downstream from the cleaning case 100 when viewed in the moving direction of the transfer belt 12.

Figure 10:
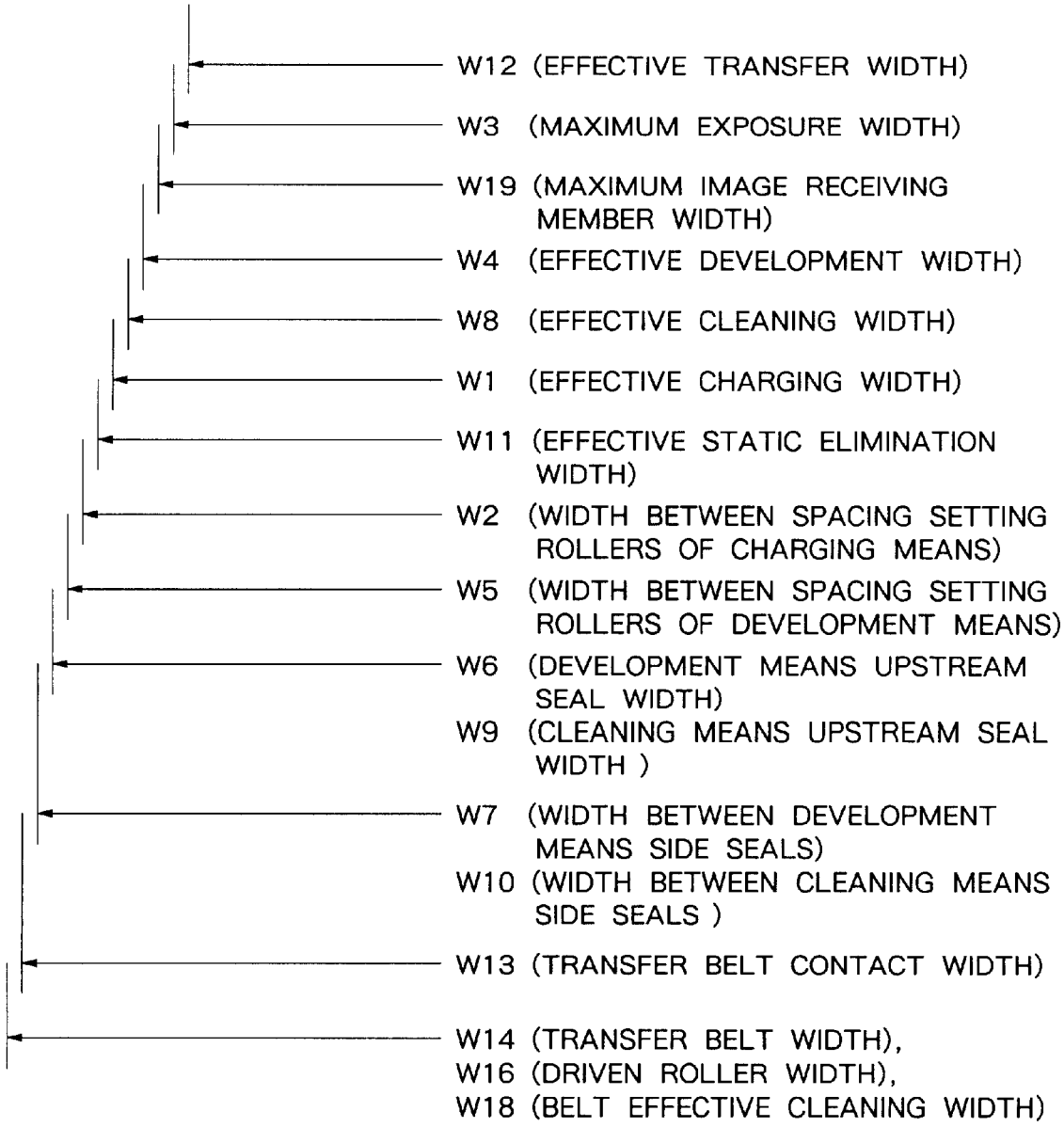
FIG. 10 is a graphical view showing the relative relationship among various widths in the image forming machine illustrated in FIG. 1.

Further referring to FIG. 10, it is important in the image forming machine constituted in accordance with the present invention that the effective contact width W13 of the transfer belt 12 be larger than the effective transfer width W12 defined by the extending width of the voltage applicator roller 84*a* and larger than the effective charging width W1 of the charging means 18*a*. As stated above, in the regions outward of the effective charging width W1, the circumferential surface of the rotating drum 14*a* can be of a potential considerably lower than the predetermined potential, or of substantially zero potential, or even of the opposite polarity. Thus, the toner can adhere to the circumferential surface of the rotating drum 14*a* in such regions. The toner adhering to the circumferential surface of the rotating drum 14*a* outwardly of the effective charging width W1 is caused to migrate from the rotating drum 14*a* to the face side of the transfer belt 12 in the transfer zone 24*a*, since the effective contact width W13 of the transfer belt 12 is larger than the effective charging width W1. The toner passed on to the face side of the transfer belt 12 is removed from the face side of the transfer belt 12 by the action of the cleaning blade 102 of the belt cleaning means 98. Thus, the toner adhering to the circumferential surface of the rotating drum 14*a* on both sides of the effective charging width W1 is prevented, fully effectively, from floating from the circumferential surface of the rotating drum 14*a* during its movement in accordance with the rotation of the rotating drum 14*a* while settling on the circumferential surface of the rotating drum 14*a*, thereby contaminating the interior or surroundings of the image forming machine. In addition, the maximum image receiving member width W19 is, usually, substantially the same as or slightly larger than the effective transfer width W12, but smaller than the effective contact width W13 of the transfer belt 12. Hence, the image receiving member is transported fully satisfactorily through the clearance between the transfer belt 12 and the rotating drum 14*a* by cooperation of the transfer belt 12 and the rotating drum 14*a*. It can be intended to enlarge the effective transfer width W12 itself and set it to be substantially the same as the effective contact width W13, thereby omitting the pressure rollers 86*a*. In this case, however, in the regions outward of the maximum image receiving member width W19 where the transfer belt 12 is directly contacted with the rotating drum 14*a* without via the image receiving member, the transfer voltage is applied to the transfer belt 12. Thus, an electric current in a relatively large amount may flow into the rotating drum 14*a*, and the rotating drum 14*a* may be deteriorated at an early stage. The toner may migrate from the rotating drum 14*a* to the transfer belt 12 over the range of the effective contact width W12, and such toner may move widthwise outwardly on the face side of the transfer belt 12. Thus, in order to remove the toner adhering to the face side of the transfer belt 12 fully satisfactorily, the effective cleaning width W18 of the belt cleaning means 98 is preferably somewhat larger than the effective contact width W13 of the transfer belt 12, and may, for example, be substantially the same as the transfer belt width W14. The effective charging width W1 of the charging means 28*a* may be somewhat larger than the effective transfer width W12 defined by the extending width of the voltage applicator roller 84*a*.

Referring to FIG. 10, in the illustrated embodiment, not only the effective charging width W1 of the charging means 18*a*, the maximum image receiving member width W19, and the effective transfer width W12 defined by the extending width of the voltage applicator roller 84*a*, but also the effective static elimination width W11 and effective cleaning width W8 in the cleaning means 34*a*, the effective development width W4 of the reversal development means 32*a*, and the maximum exposure width W3 of the exposure means 30*a* are made smaller than the effective contact width W13 of the transfer belt 12. The interrelation of these various widths is set to be W13>W11>W8>W4>W19>W3.

The width W2 concerned with the pair of spacing setting rollers 42*a* in the charging means 28*a*, the width W5 concerned with the pair of spacing setting rollers 52*a* in the reversal development means 32*a*, the width W6 of the upstream sealing member 54*a* in the reversal development means 32*a*, the width W7 concerned with the pair of side sealing members 56*a* in the reversal development means 32*a*, the width W9 of the upstream sealing member 64*a* in the cleaning means 34*a*, and the width W10 concerned with the pair of side sealing members 66*a* in the cleaning means 34*a* are also preferably smaller than the effective contact width W13 of the transfer belt 12. If the widths are so set, in the ranges of the widths W2, W5, W6, W7, W9 and W10, the toner adhering to the outer peripheral surface of the rotating drum 14*a* is transferred to the face side of the transfer belt 12, and the toner does not remain on the outer peripheral surface of the rotating drum 14*a*. Therefore, the toner is prevented fully reliably from building up between the spacing setting rollers 42*a* and 52*a* and the outer peripheral surface of the rotating drum 14*a* and spoiling the setting of spacing. Moreover, the toner is prevented fully reliably from building up between the sealing members 54*a*, 56*a*, 64*a* and 66*a* and the outer peripheral surface of the rotating drum 14*a* and spoiling the sealing effect of the sealing members 54*a*, 56*a*, 64*a* and 66*a*.

What we claim is:

1. An image forming machine comprising:

image bearing means moved sequentially through a charging zone, an exposure zone, a development zone, a transfer zone, and a cleaning zone;

charging means for charging the image bearing means in the charging zone;

exposure means for selectively static-eliminating the image bearing means in the exposure zone to form an electrostatic latent image on the image bearing means;

reversal development means for developing the electrostatic latent image into a toner image in the development zone;

transfer means for transferring the toner image on the image bearing means onto an image receiving member in the transfer zone; and cleaning means for removing a toner remaining on the image bearing means in the cleaning zone after transfer, the transfer means including a rotationally driven transfer belt, and transfer voltage applicator means for applying a transfer voltage to a back side of the transfer belt, and wherein the charging means charges the image bearing means over a predetermined effective charging width, the transfer voltage applicator means applies the transfer voltage to the transfer belt over a predetermined effective transfer width, a face side of the transfer belt is brought into contact with the image bearing means via the image receiving member and directly over a predetermined effective contact width, and the effective contact width is larger than the effective charging width and larger than the effective transfer width.

2. The image forming machine of claim 1, wherein the effective contact width is larger than a maximum image receiving member width.

3. The image forming machine of claim 1, wherein the transfer means includes belt cleaning means for removing an adhered toner from the face side of the transfer belt, and an effective cleaning width of the belt cleaning means is larger than the effective contact width.

4. The image forming machine of claim 1, wherein the effective transfer width is smaller than the effective charging width.

5. The image forming machine of claim 1, wherein the transfer voltage applicator means is composed of a voltage applicator roller which is formed from an electrically conductive material and to which the transfer voltage is applied.

6. The image forming machine of claim 5, wherein the transfer means includes pressure rollers which are arranged on both sides of the voltage applicator roller concentrically with the voltage applicator roller, and which act on the back side of the transfer belt to press the face side of the transfer belt against the image bearing means.

7. The image forming machine of claim 6, wherein the voltage applicator roller and the pressure rollers are fixed to an electrically conductive common support shaft which is rotatably mounted, the transfer voltage is applied to the voltage applicator roller via the common support shaft, and the pressure rollers are formed from an insulating material.

8. The image forming machine of claim 5, wherein the transfer means includes pressure rollers which are arranged upstream and/or downstream from the voltage applicator roller when viewed in a direction of movement of the transfer belt, and which act on the back side of the transfer belt to press the face side of the transfer belt against the image bearing means, and the pressure rollers extend continuously over the effective contact width.

9. An image forming machine comprising:

image bearing means moved sequentially through a charging zone, an exposure zone, a development zone, a transfer zone, and a cleaning zone;

charging means for charging the image bearing means in the charging zone;

exposure means for selectively static-eliminating the image bearing means in the exposure zone to form an electrostatic latent image on the image bearing means;

reversal development means for developing the electrostatic latent image into a toner image in the development zone;

transfer means for transferring the toner image on the image bearing means onto an image receiving member in the transfer zone; and cleaning means for removing a toner remaining on the image bearing means in the cleaning zone after transfer, the transfer means including a rotationally driven transfer belt, and transfer voltage applicator means for applying a transfer voltage to a back side of the transfer belt, and wherein the reversal development means develops the image bearing means over a predetermined effective development width, the transfer voltage applicator means applies the transfer voltage to the transfer belt over a predetermined effective transfer width, a face side of the transfer belt is brought into contact with the image bearing means via the image receiving member and directly over a predetermined effective contact width, and the effective contact width is larger than the effective development width and larger than the effective transfer width.

10. The image forming machine of claim 9, wherein the development means includes a development housing having an opening at a site facing the image bearing means, developer applicator means disposed in the development housing and adapted to act on the image bearing means through the opening, and an upstream sealing member disposed in the development housing and having a free end brought into contact with the image bearing means upstream from the developer applicator means, and the upstream sealing member has a width larger than the effective development width and smaller than the effective contact width.

11. The image forming machine of claim 9, wherein the development means includes a development housing having an opening at a site facing the image bearing means, developer applicator means disposed in the development housing and adapted to act on the image bearing means through the opening, and a pair of side sealing members disposed in the development housing and brought into contact with the image bearing means on both sides of the developer applicator means, and a length between outside ends of the pair of side sealing members is larger than the effective development width and smaller than the effective contact width.

12. The image forming machine of claim 9, wherein the development means includes a development housing having an opening at a site facing the image bearing means, developer applicator means disposed in the development housing and adapted to act on the image bearing means through the opening, and a pair of spacing setting rollers rotatably mounted on the development housing and brought into contact with the image bearing means on both sides of the developer applicator means, and a length between outside ends of the pair of spacing setting rollers is larger than the effective development width and smaller than the effective contact width.

13. The image forming machine of claim 9, wherein the effective contact width is larger than a maximum image receiving member width.

14. The image forming machine of claim 9, wherein

The transfer means includes belt cleaning means for removing an adhered toner from the face side of the transfer belt, and an effective cleaning width of the belt cleaning means is larger than the effective contact width.

15. An image forming machine comprising:

image bearing means moved sequentially through a charging zone, an exposure zone, a development zone, a transfer zone, and a cleaning zone;

charging means for charging the image bearing means in the charging zone;

exposure means for selectively static-eliminating the image bearing means in the exposure zone to form an electrostatic latent image on the image bearing means;

reversal development means for developing the electrostatic latent image into a toner image in the development zone;

transfer means for transferring the toner image on the image bearing means onto an image receiving member in the transfer zone; and cleaning means for removing a toner remaining on the image bearing means in the cleaning zone after transfer, the transfer means including a rotationally driven transfer belt, and transfer voltage applicator means for applying a transfer voltage to a back side of the transfer belt, and wherein the cleaning means removes the toner remaining on the image bearing means over a predetermined effective cleaning width, the transfer voltage applicator means applies the transfer voltage to the transfer belt over a predetermined effective transfer width, a face side of the transfer belt is brought into contact with the image bearing means via the image receiving member and directly over a predetermined effective contact width, and the effective contact width is larger than the effective cleaning width and larger than the effective transfer width.

16. The image forming machine of claim 15, wherein the cleaning means includes a cleaning housing having an opening at a site facing the image bearing means, a cleaning blade disposed in the cleaning housing and having a front edge portion pressed against the image bearing means, and an upstream sealing member disposed in the cleaning housing and having a free end brought into contact with the image bearing means upstream from the cleaning blade, and the upstream sealing member has a width larger than the effective cleaning width and smaller than the effective contact width.

17. The image forming machine of claim 16, wherein the cleaning means includes a cleaning housing having an opening at a site facing the image bearing means, a cleaning blade disposed in the cleaning housing and having a front edge portion pressed against the image bearing means, and a pair of side sealing members disposed in the cleaning housing and brought into contact with the image bearing means on both sides of the cleaning blade, and a length between outside ends of the pair of side sealing members is larger than the effective cleaning width and smaller than the effective contact width.

18. The image forming machine of claim 15, wherein the effective contact width is larger than a maximum image receiving member width.

19. The image forming machine of claim 15, wherein the transfer means includes belt cleaning means for removing an adhered toner from the face side of the transfer belt, and an effective cleaning width of the belt cleaning means is larger than the effective contact width.

20. An image forming machine comprising:

image bearing means moved sequentially through a charging zone, an exposure zone, a development zone, a transfer zone, and a cleaning zone;

charging means for charging the image bearing means in the charging zone;

exposure means for selectively static-eliminating the image bearing means in the exposure zone to form an electrostatic latent image on the image bearing means;

reversal development means for developing the electrostatic latent image into a toner image in the development zone;

transfer means for transferring the toner image on the image bearing means onto an image receiving member in the transfer zone; and cleaning means for removing a toner remaining on the image bearing means in the cleaning zone after transfer, the transfer means including a rotationally driven transfer belt, and transfer voltage applicator means for applying a transfer voltage to a back side of the transfer belt, and wherein the charging means includes a corona discharger for charging the image bearing means over a predetermined effective charging width, and a pair of spacing setting rollers rotatably mounted on the corona discharger and brought into contact with the image bearing means on both sides of the effective charging width, and a length between outside ends of the pair of spacing setting rollers is larger than the effective charging width and smaller than the effective contact width.

21. The image forming machine of claim 20, wherein the effective contact width is larger than a maximum image receiving member width.

22. The image forming machine of claim 20, wherein the transfer means includes belt cleaning means for removing an adhered toner from the face side of the transfer belt, and an effective cleaning width of the belt cleaning means is larger than the effective contact width.

* * * * *